US005737879A

United States Patent [19]

Sweet

[11] Patent Number: 5,737,879

[45] Date of Patent: Apr. 14, 1998

[54] DEBRIS BLOCKING GUTTER AND SUPPORT HANGER

[76] Inventor: Vernon L. Sweet, 6363 Douglas Rd., Lambertville, Mich. 48144

[21] Appl. No.: 829,653

[22] Filed: Mar. 31, 1997

[51] Int. Cl.[6] ..... E04D 13/076

[52] U.S. Cl. ..... 52/12; 52/11; 52/712; 248/48.1; 248/48.2

[58] Field of Search ..... 52/12, 11, 712; 248/48.1, 48.2

[56] References Cited

U.S. PATENT DOCUMENTS

| | | | |
|---|---|---|---|
| 891,406 | 6/1908 | Cassens | 248/48.2 X |
| 3,752,428 | 8/1973 | Trostle et al. | 248/48.2 |
| 4,497,146 | 2/1985 | Demartini | 52/12 |
| 4,757,649 | 7/1988 | Vahldieck . | |
| 4,776,544 | 10/1988 | Williams | 248/48.1 |
| 5,189,849 | 3/1993 | Collins | 52/12 |
| 5,495,694 | 3/1996 | Kuhns | 52/12 |
| 5,570,860 | 11/1996 | Schoenherr | 52/11 X |
| 5,575,118 | 11/1996 | Vahldieck . | |
| 5,588,261 | 12/1996 | MacConochie . | |
| 5,660,001 | 8/1997 | Albracht | 52/712 X |

OTHER PUBLICATIONS 12 pg. Installation document from Gutter ARMOR (Copyright 1994).

2 pg. flyer from Gutter ARMOR titled "The Gutter Armor Advantage".

2 pg. flyer from Gutter ARMOR titled "Three Simple Steps of Installation".

*Primary Examiner*—Robert Canfield

*Attorney, Agent, or Firm*—MacMillan, Sobanski & Todd

[57] ABSTRACT

A debris blocking gutter system includes a gutter having a front wall, a bottom wall and a rear wall forming a trough for receiving water. A shield for covering at least a portion of the trough includes a cover portion and a downwardly projecting blocking wall. A hanger or bracket includes a first arm for supporting the front wall and preventing it from collapsing due to the weight of debris. The hanger includes a second arm for supporting the shield without contacting the cover portion. The first and second arms prevents the gutter from collapsing due to the weight of debris such as snow and ice.

17 Claims, 4 Drawing Sheets

DEBRIS BLOCKING GUTTER AND SUPPORT HANGER

BACKGROUND OF THE INVENTION

This invention relates generally to gutters for buildings and other structures, and in particular is concerned with a gutter and hanger system which deflects debris and blocks it from falling into a trough of the gutter.

Gutters for buildings are well known. Many gutters include open horizontal troughs or channels which receive rain water. Gutters are usually secured to exterior walls adjacent caves of a building to carry away water. Gutters can be connected to closed vertical conduits, commonly referred to a downspouts, drainspouts or conductors, to direct water to a drain or to the ground away from a building. Popular cross sections or configurations for gutters include generally rectangular and semi-circular designs. Oftentimes, hangers or brackets are used to attach gutters to a mounting surface.

Modern gutters can be formed by bending a coiled strip of material to a desired profile and cutting the strip to a desired length. Popular materials for gutters include aluminum, copper and steel. A strip can be bent by a machine having a series of rollers to produce the desired profile. Such a machine is commonly referred to as a rollformer.

Leaves and other debris fall may into the open trough of a gutter. As such foreign matter accumulates in a gutter, it can tend to clog a gutter and prevent the free flow of water. To combat this problem, screens and guards adapted to be mounted on an open gutter have been developed. Such screens can be mounted on a gutter by fasteners and clips or can be positioned between front and back walls of a gutter and retained by front and rear edges which engage respective walls. Gutters with integrally formed shields have been used prevent debris from falling into troughs. Examples of such gutters can be seen in U.S. Pat. Nos. 4,757,649 and 5,575,118.

The art continues to seek improvements. It is desirable to from a gutter system which is economical to manufacture, easy to install, and prevents debris from falling into a trough. Furthermore, it is desirable to provide a supported gutter which will not collapse and fail due to heavy debris such as snow and ice.

SUMMARY OF THE INVENTION

This invention relates to rain gutters for buildings and other structures. A gutter system includes a gutter having a front wall and a shield. The shield includes a cover portion and a downwardly projecting blocking wall. Water dripping from a roof runs across the cover portion and over the blocking wall to an angled wall to drop into a trough. A gap is provided between the front wall and blocking wall of the shield so that water can enter the trough. A hanger includes a first arm for supporting the front wall and preventing it from collapsing from the weight of debris. Furthermore, the hanger includes a second arm for supporting the shield and preventing it from collapsing from the weight of debris. The second arm engages the angled wall and does not engage the cover portion.

In a preferred embodiment, a debris blocking gutter system includes a gutter having a front wall, a bottom wall and a rear wall forming a trough for receiving water. A shield for covering at least a portion of the trough includes a cover portion and a downwardly projecting blocking wall. A hanger or bracket includes a first arm for supporting the front wall and preventing it from collapsing due to the weight of debris. The hanger includes a second for supporting the shield and preventing it from collapsing due to the weight of debris.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 1:
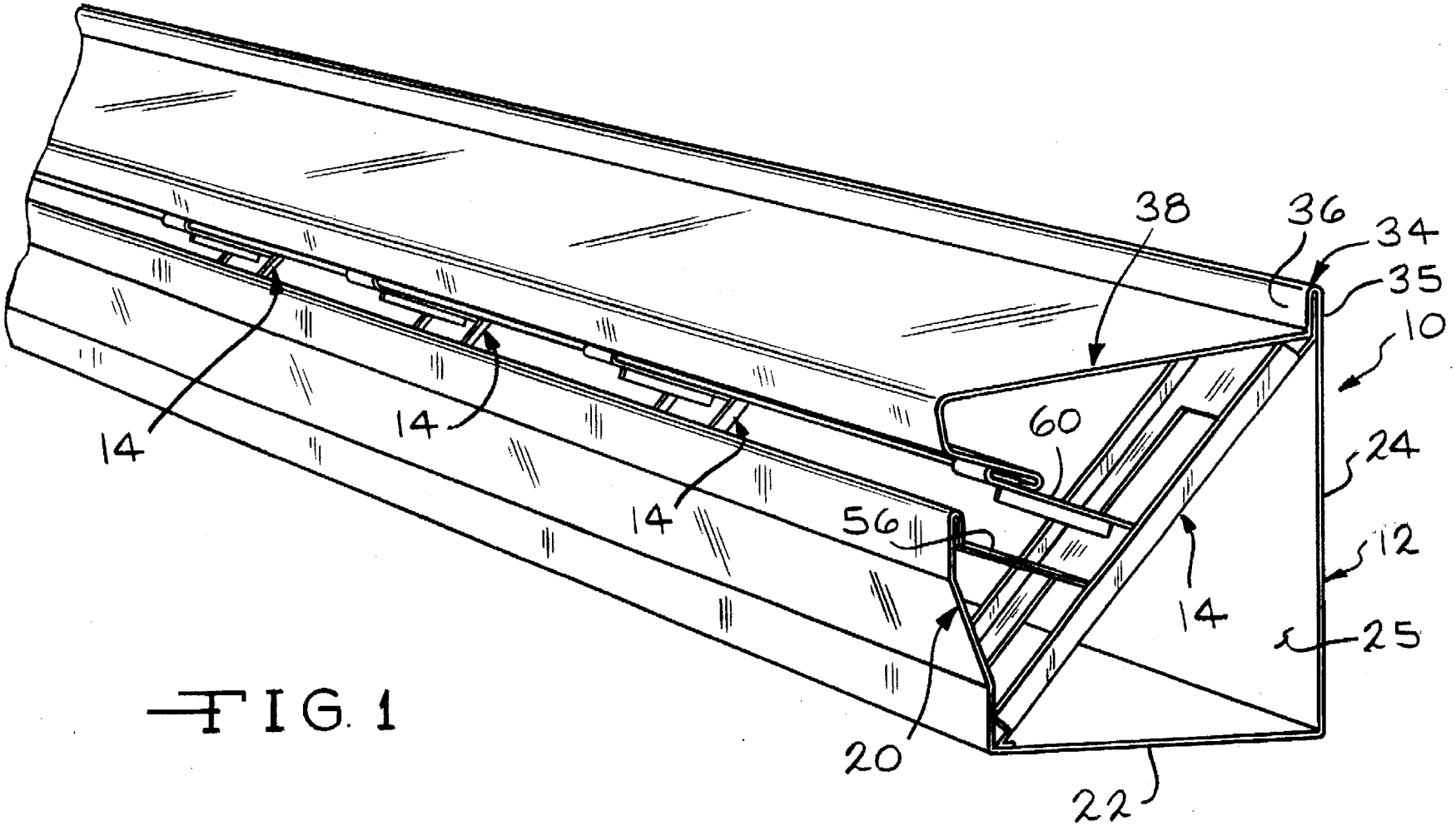
FIG. 1 is a perspective view of a gutter system according to the present invention.
Figure 2:
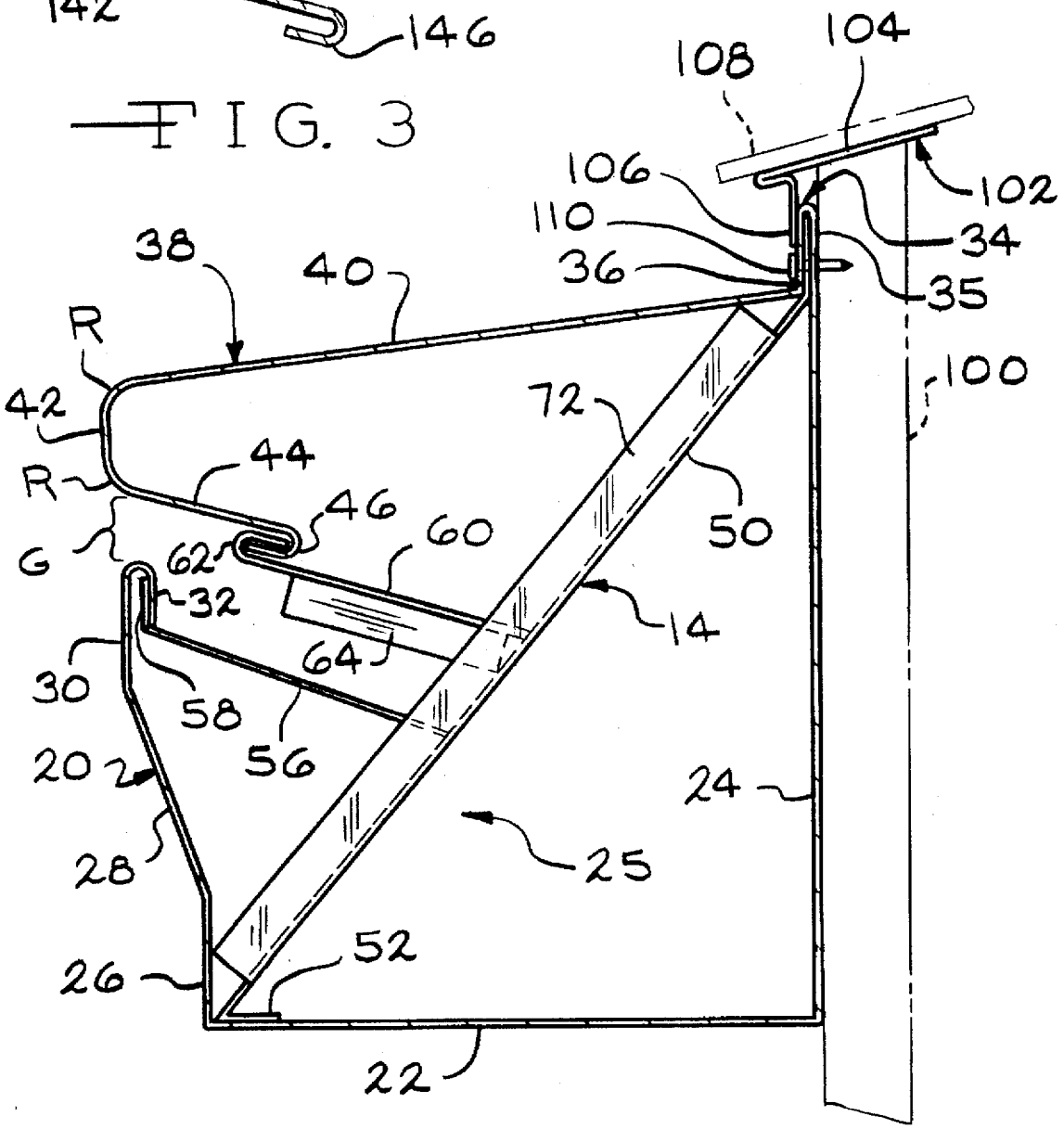
FIG. 2 is a sectional view of the gutter system illustrated in FIG. 1 mounted on a fascia board at the roof line of a building.

A gutter system according to the present invention is indicated generally at 10 and illustrated in FIGS. 1 and 2. The gutter system 10 is particularly adapted for carrying water away from a building or other structure and includes a gutter indicated generally at 12 and a support hanger indicated generally at 14. The gutter system 10 prevents leaves, twigs and other debris from falling into and possibly clogging the gutter 12.

Preferably, the gutter system 10 is mounted to a fascia board or other outer surface 100 (see FIG. 2) of an exterior wall adjacent a roof line of a structure or building. The gutter system 10 can cooperate with a drip edge 102 mounted on the building. The drip edge 102 can be formed from a bendable material and may include an upper portion 104 and a lower portion 106. The upper portion 104 can be inserted beneath shingles 108 or other coverings on the roof and secured to the roof. Preferably the lower portion 106 of the drip edge 102 extends substantially vertically and is spaced a predetermined distance from the fascia board 100. Fasteners 110 such as nails, screws, etc. are used to secure the drip edge 102, gutter 12 and hanger 14 to the fascia board 100.

In the embodiment illustrated, the gutter 12 includes a front wall indicated generally at 20, a bottom wall 22 and a rear wall 24 which form a trough or channel 25 for receiving and carrying water. The front wall 20 may include a first substantially vertical section 26, a forwardly angled section 28, and a second substantially vertical section 30. Preferably, the front wall 20 terminates in a downwardly projecting hem 32 formed by bending or curling. As described below, the hem 32 functions like a hook. Preferably, sections 26, 28, and 30 and the hem 32 are formed by bending the front wall 20 as desired. In other embodiments, the front wall 20 may be comprised of more or fewer sections of varying orientations.

The bottom wall 22 is preferably a planar wall. However, in other embodiments of the gutter 12, the bottom wall 22 may be curved, e.g., in a concave manner, or may include various bent sections oriented as desired.

The rear wall 24 is preferably vertical and rests against the fascia board 100. A mounting flange indicated generally at 34 is formed by a first wall 35 placed against the fascia board 100 and a second wall 36 spaced forward of the first wall 35. Preferably, the first wall 35 is integrally formed with the rear wall 24 and the second wall 36 is formed by bending a suitable material. When the gutter 12 is mounted on the fascia board 100 and used with a drip edge 102, the mounting flange 34 is inserted between a lower portion 106 of the drip edge 102 and the fascia board 100.

The gutter 12 includes a shield indicated generally at 38 which substantially covers the trough 25 and prevents leaves, twigs and other debris from entering the trough 25. Preferably, the shield 38 includes a cover section 40 integrally formed with the second wall 36 of the mounting flange 34. The cover section 40 extends away from the rear wall 24 a predetermined distance and covers at least a portion of the trough 25. While the cover section 40 is illustrated as a planar member, a downwardly curved cover section 40 car, be used in other embodiments. Preferably, the cover section 40 is sloped downwardly from the rear wall 24 to the front wall 20.

The cover section 40 terminates in a downwardly projecting blocking wall 42 and a rearwardly projecting angled wall 44. Preferably, the blocking wall 42 is a planar member which extends substantially vertically. In the embodiment illustrated in FIGS. 1 and 2, a radius R is formed at the intersections of the cover section 40 and the blocking wall 42 and the blocking wall 42 and the angled wall 44. In other words, these intersections are formed with "rounded comers." Preferably, the angled wall 44 slopes downwardly from the blocking wall 42 toward the rear wall 24 and projects rearwardly toward the rear wall 24 past the front wall 20 of the gutter 12. The angled wall 44 terminates in a forwardly projecting hem 46 formed by bending or curling. As described below, the hem 46 functions like a hook.

Water contacting the shield 38 travels downwardly over the cover portion 40 toward the blocking wall 42 and around the radius R between the blocking wall 42 and the angled wall 44 into the trough 25. Water initially adheres to the outer surface of the angled wall 44 and then drops into the trough 25 in a well known manner. As illustrated, a gap G of a predetermined distance is provided between the shield 38 and the front wall 20 so that water may enter the trough 25. The gap G is FIG. 2 is measured between a lower end of the blocking wall 42 and the upper surface of the front wall 20. Leaves and other debris traveling with the water across the cover section 40 do not enter the gap G and thus are deflected or blocked from entering the trough 25. As water travels down the blocking wall 42, debris falls downwardly away from the gutter system 10. The substantially vertical blocking wall 42 prevents debris from blowing into the trough 25.

The shield 38 must be sized so that water dripping from the angled wall 44 will fall into the trough 25. If desired, one or more ridges (not illustrated) can be formed in the cover section 40. The ridges can be formed along the length of the shield 38, preferably substantially parallel with the rear wall 24 and assist with the drying of leaves and other debris which may rest on the upper surface of the shield 38. Once such debris is relatively dry, wind can easily blow the debris from the shield 38.

Preferably, the front wall 20, bottom wall 22, rear wall 24, mounting flange 34, and shield 38 are integrally formed by bending any suitable material such as aluminum. In other embodiments, the components of the gutter 12 can be integrally formed by molding. In yet other embodiments, the components of the gutter 12 can be separately formed and attached as desired.

Figure 3:
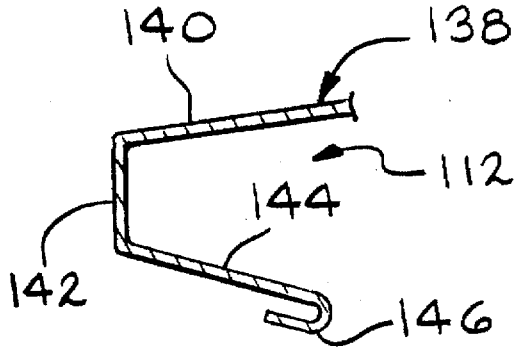
FIG. 3 is an enlarged, fragmentary view of a second embodiment of a gutter for use in the present gutter system.

A second embodiment of a gutter 112 for use in a gutter system according to this invention is partially illustrated in FIG. 3. Gutter 112 can be identical to gutter 12 except for the intersections of the cover section 140 with the blocking wall 142 and the blocking wall 142 with the angled wall 144. As compared to the "rounded comers" of gutter 12, the intersections of gutter 12 can be formed by bending a material. When compared to gutter 12, the intersections of gutter 112 may be characterized as having "sharp corners."

Figure 4:
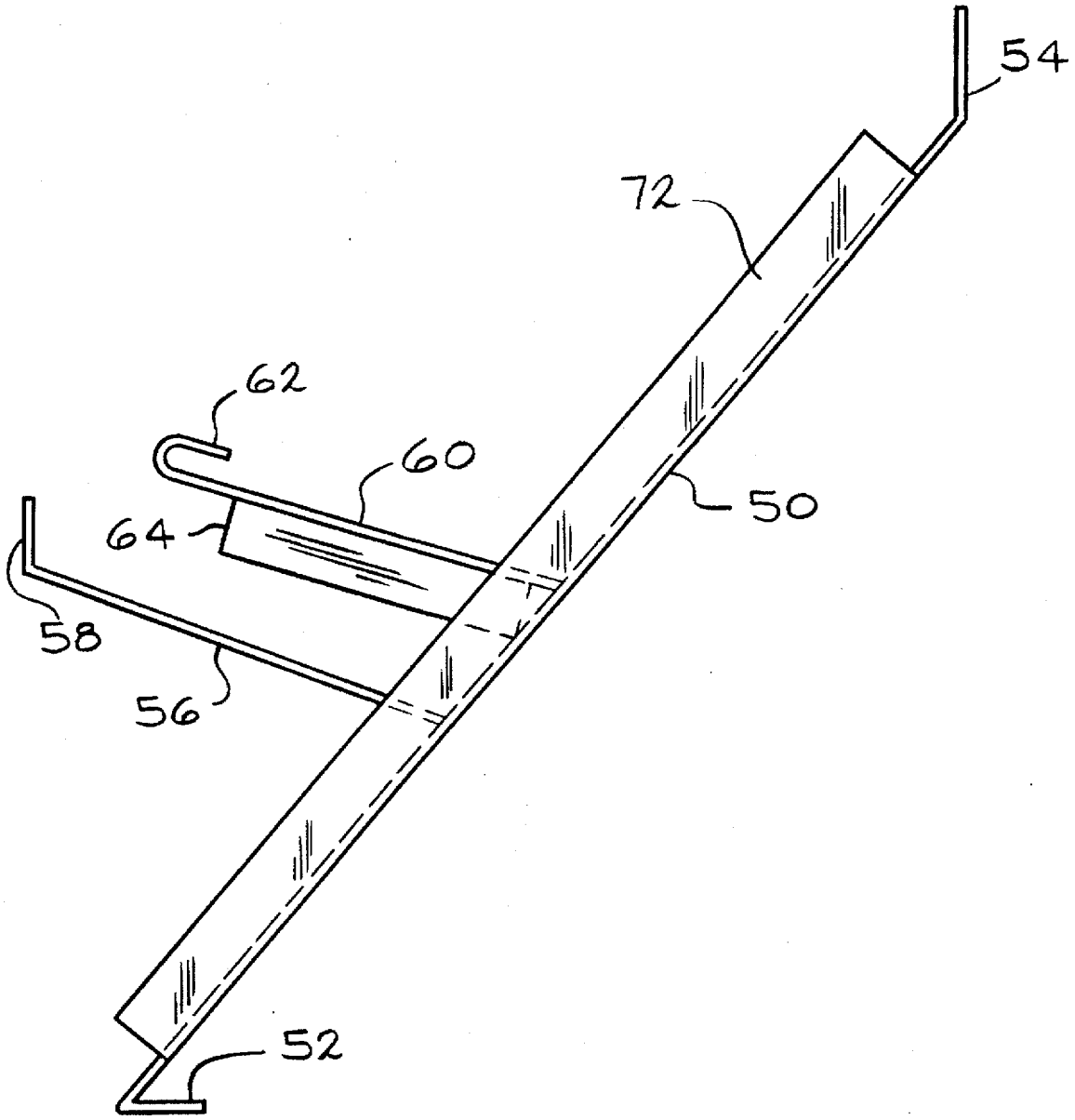
FIG. 4 is an end view of a support hanger of the gutter system of FIGS. 1 and 2 removed from the gutter system for clarity of illustration.
Figure 5:
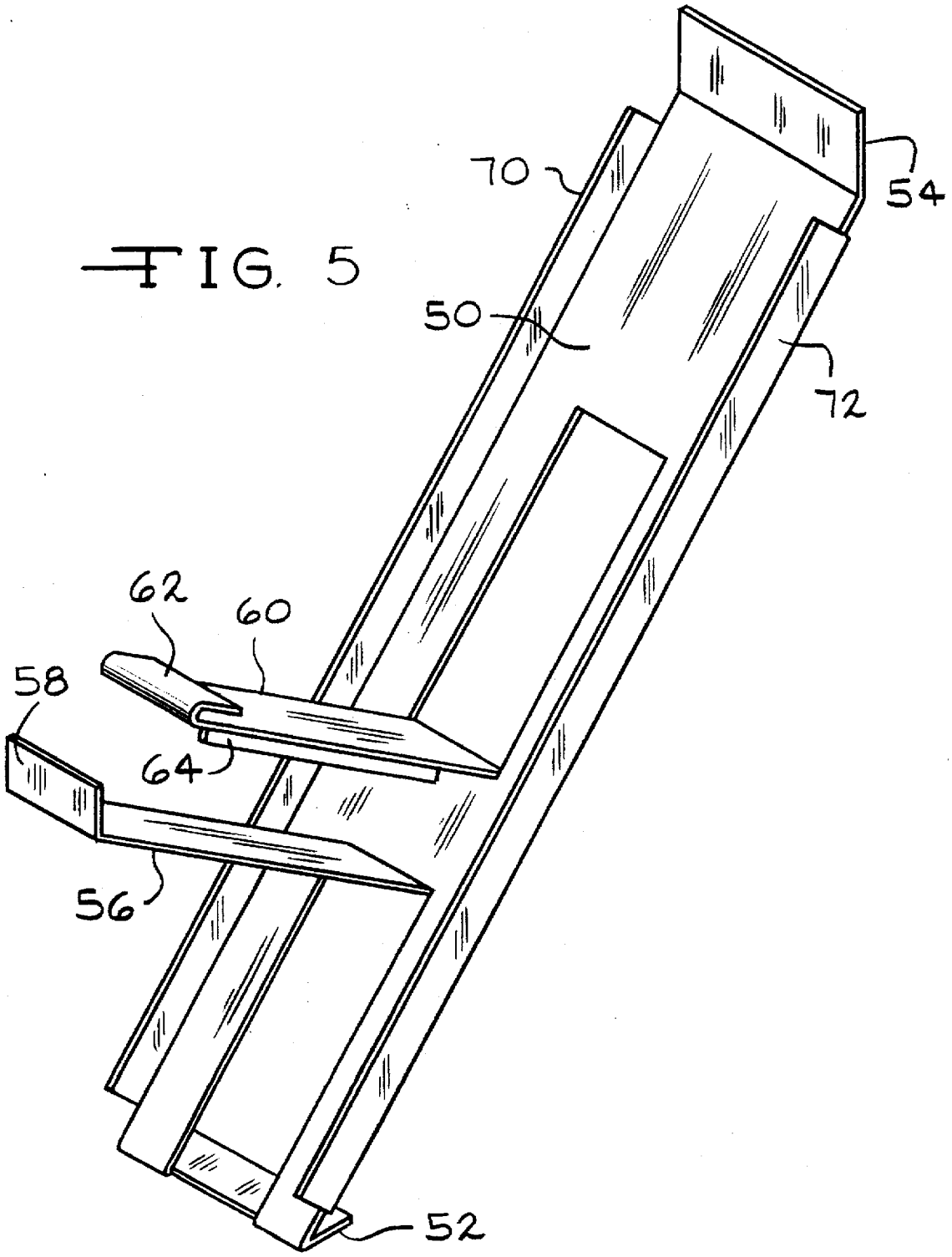
FIG. 5 is a perspective view of the hanger of FIG. 4.

The hanger 14, also known as a bracket, supports the gutters 12 and 112 and prevents the gutters 12 and 112 from collapsing due to the weight of accumulated debris. The hanger 14, illustrated separately in FIGS. 4 and 5, includes a main body 50 which is diagonally oriented when installed in the gutters 12 and 112. The main body 50 includes a rearwardly projecting base 52 which rests on an upper surface of the bottom wall 22. A substantially vertical stem 54 is formed at an opposite end of the main body 50 and is received in the mounting flange 34 when the hanger 14 is positioned in the gutter 12 as illustrated in FIGS. 1 and 2. As shown best in FIG. 2, the main body 50 is preferably generally diagonally angled between a corner formed by the front wall 20 and the bottom wall 22 and the mounting flange 34.

The hanger 14 includes supports for the front wall 20 and shield 38 of the gutter 12. A first arm 56 is formed in a lower portion of the main body 50. Preferably, the arm 56 is preferably formed by cutting and bending a predetermined portion of the main body 50 away from its remainder. The first arm 56 terminates in an upwardly projecting stem 58 which is received by the hem 32 of the front wall 20. In other words, the hem 32 Books onto the stem 58. In this manner, the front wall 20 is supported by arm 56 and resists collapsing inwardly toward the rear wall 24 or pulling outwardly away from the rear wall 24.

The hanger 14 includes a second arm 60 which supports the shield 38. The second arm 60 is preferably formed in an upper portion of the main body 50 by cutting and bending a predetermined portion of the main body 50 away from its remainder. The second arm 60 terminates in a rearwardly projecting hem 62 which is received by the hem 46 of the shield 38. In other words, hem 62 hooks onto hem 46. In this manner, the shield 38 is supported by urn 60 and resists collapsing downwardly toward the bottom wall 22 or pulling outwardly away from the bottom wall 22. The second arm 60 supports the shield 38 by engaging the hem 46 of the rearwardly angled wall 44 and does not directly contact the cover portion 40 of the shield 38. If desired, one or more supports 64 (only one is illustrated in the figures) can be formed along the longitudinal portion of the arm 60 to support the arm 60. When the arm 60 is bent downwardly from the main body 50, the support 64 engages the main body 50 between the first arm 52 and the second arm 60.

If desired, longitudinal ribs 70 and 72 can be formed along at least a portion of the sides of the main body 50. Ribs 70 and 72 provide additional strength to the main body 50 to resist bending.

The hanger 14 can be formed from any desirable material, including any bendable material. Also, the hanger 14 can be formed by molding any suitable material. After the main body 50 is formed, a first arm 56 is formed from a portion of the main body 50 by cutting, stamping, etc. and bending the arm 56 away from the remainder of the main body 50. A second arm 60 is foiled from a portion of the main body 50 by cutting, stamping, etc. and bending the arm 60 away from the remainder of the main body 50.

Preferably, the gutter 12, 112 is formed as a continuous member of a desired length. Hangers or brackets 14 are inserted into an open end of the gutter 12, 112 and spaced along the length of the gutter 12, 112 as desired. Fasteners 110 are used to secure the gutter 12, 112 and brackets 14 in place. Thus, the gutter system 10 described herein provides a supported gutter 12 which prevents substantial amounts of debris from reaching the trough 25 and possibly clogging the gutter 12. The gutter system 10 also provides a support bracket 14 which supports both the front wall 20 and shield 38 of the gutter 12. Heavy debris such as snow and ice are prevented from collapsing the shield 38 and front wall 20 and rendering the gutter 12 ineffective.

in accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A gutter system comprising:

a gutter having (i) a trough for receiving water formed by a front wall, a bottom wall and a rear wall, and (ii) a shield, integrally formed with the rear wall, covering at least a portion of the trough to prevent debris from entering the trough, the shield including a cover section terminating in a planar, downwardly projecting blocking wall and a rearwardly projecting angled wall, wherein a gap is provided between a lower end of the blocking wall and the front wall; and a hanger having a first arm supporting the front wall and a second arm supporting the shield.

2. The gutter system defined in claim 1 wherein the rearwardly projecting angled wall slopes downwardly from the blocking wall toward the rear wall.

3. The gutter system defined in claim 1 wherein the first arm terminates in a stem cooperating with a hem formed on the front wall of the gutter.

4. The gutter system defined in claim 1 wherein the rearwardly projecting angled wall terminates in a hem cooperating with a hem formed on the second arm of the hanger.

5. The gutter system defined in claim 1 wherein the hanger includes a main body from which the first and second arms extend.

6. The gutter system defined in claim 5 wherein the second arm includes a support.

7. The gutter system defined in claim 1 wherein the gutter includes a mounting flange and the hanger includes a stem received in the mounting flange.

8. The gutter system defined in claim 1 wherein the blocking wall extends substantially vertically.

9. A debris blocking gutter system comprising:

a gutter having an integrally formed front wall, bottom wall, rear wall, and shield, the shield including a cover section, a downwardly projecting blocking wall, and a reawardly projecting angled wall; and a hanger having an integrally formed first arm supporting the front wall and an integrally formed second arm supporting the shield without contacting the cover section of the shield.

10. The debris blocking gutter system defined in claim 9 wherein the hanger includes a main body from which portions are cut and bent to form the first and second arms.

11. The debris blocking gutter system defined in claim 9 wherein the first arm terminates in a stem and the second arm terminates in a hem each of which hooks onto a respective hem of the gutter.

12. The debris blocking gutter system defined in claim 9 wherein the blocking wall is substantially vertical.

13. The debris blocking gutter system defined in claim 10 wherein the main body includes a base at one end and a stem at an opposite end.

14. The debris blocking gutter system defined in claim 13 wherein the hanger is oriented diagonally with respect to the gutter when the base rests on the bottom wall and the stem is received in a mounting flange of the gutter formed between the rear wall and the shield.

15. The debris blocking gutter system defined in claim 9 wherein the first and second arms are formed by cutting and bending a portion of the main body away from the remainder of the main body.

16. The debris blocking guttter system defined in claim 10 wherein the main body includes at least one rib.

17. A gutter adapted for use with a building comprising:

a trough for receiving water formed by a front wall, a bottom wall and a rear wall; and a shield, integrally formed with the rear wall, covering at least a portion of the trough to prevent debris from entering the trough, the shield including a cover section terminating in a planar, downwardly projecting blocking wall and a rearwardly projecting angled wall, wherein a gap is provided between a lower end of the blocking wall and the front wall.

* * * * *